US008985187B2

(12) United States Patent
Palmer et al.

(10) Patent No.: US 8,985,187 B2
(45) Date of Patent: Mar. 24, 2015

(54) AUTO-CLOSER FOR CENTERING AND CLOSING COPE AND DRAG SAND MOLD HALVES

(71) Applicant: Palmer Manufacturing and Supply, Inc., Springfield, OH (US)

(72) Inventors: John S Palmer, Springfield, OH (US); Timothy William Parshall, Hillsboro, OH (US)

(73) Assignee: Palmer Manufacturing and Supply, Inc., Springfield, OH (US)

( * ) Notice: Subject to any disclaimer, the term of this patent is extended or adjusted under 35 U.S.C. 154(b) by 104 days.

(21) Appl. No.: 13/687,241

(22) Filed: Nov. 28, 2012

(65) Prior Publication Data

US 2014/0143995 A1 May 29, 2014

(51) Int. Cl.
*B22D 33/04* (2006.01)

(52) U.S. Cl.
CPC ..... *B22D 33/04* (2013.01)
USPC ..... 164/339; 164/341

(58) Field of Classification Search
CPC ..... B22D 33/00; B22D 33/04; B22D 33/005
USPC ..... 164/339, 137, 341
See application file for complete search history.

(56) References Cited

U.S. PATENT DOCUMENTS

| | | | | |
|---|---|---|---|---|
| 4,139,049 | A * | 2/1979 | Baumann et al. | 164/292 |
| 4,202,403 | A * | 5/1980 | Miller | 164/409 |
| 4,890,664 | A * | 1/1990 | Hunter | 164/182 |
| 7,392,835 | B2 * | 7/2008 | Watkins et al. | 164/339 |
| 7,967,054 | B2 | 6/2011 | Deutschmann et al. | |
| 7,997,326 | B2 * | 8/2011 | Onda | 164/339 |

* cited by examiner

*Primary Examiner* — Kevin P Kerns
(74) *Attorney, Agent, or Firm* — Harness, Dickey & Pierce, PLC

(57) ABSTRACT

A positioning station supports a sand mold half while centering using two sets of moveable arms. A gripping structure having two inwardly facing pads are each mounted for rotation about a common axis on separate axles. The pads remain in a fixed angular relationship to one another throughout rotational movement. Each pad has plural individual compressible fingers and a fixed fulcrum structure pointing inwardly towards the opposite pad and adapted to grip a sand mold half by engaging the surface of the sand mold half. The gripping structure is lifted away from the platform sufficient to allow a second sand mold half to be placed on the platform and then the gripping structure is lowered to accurately mate the two mold halves.

10 Claims, 8 Drawing Sheets

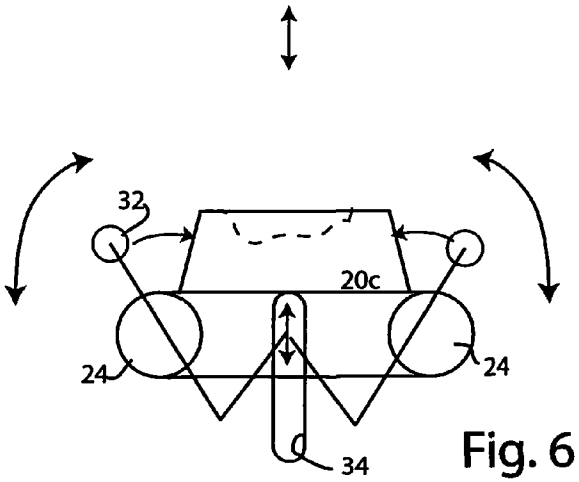
Fig. 6
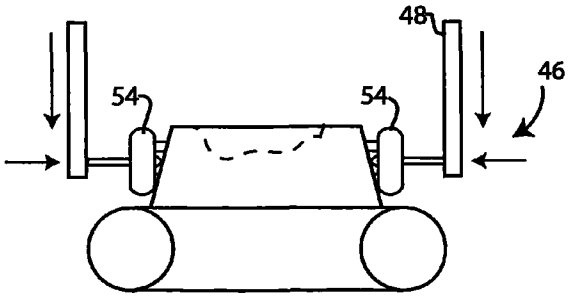
Fig. 7
Fig. 5
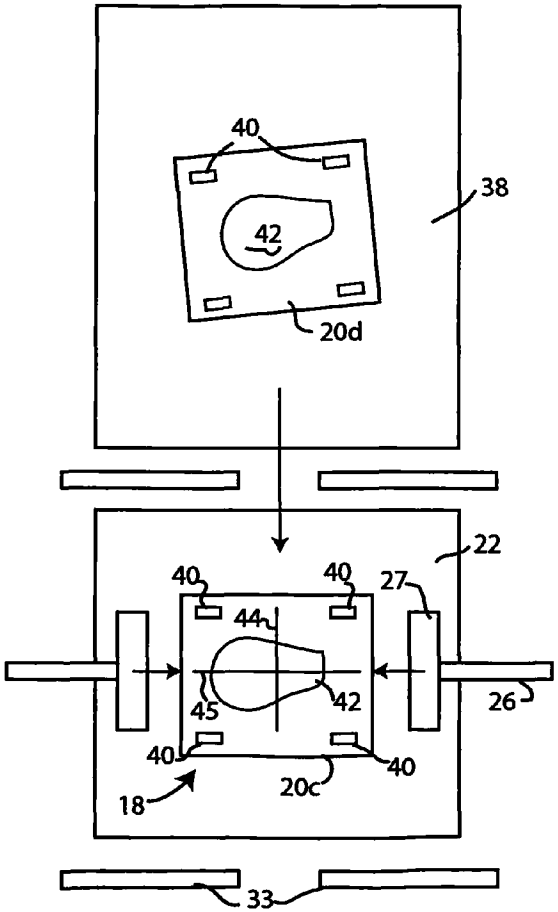

AUTO-CLOSER FOR CENTERING AND CLOSING COPE AND DRAG SAND MOLD HALVES

FIELD

The present disclosure relates generally to matchplate sand casting. More particularly, the disclosure relates to an apparatus and method to center and close the cope and drag halves of a sand mold through a technique that allows automated handling of the sand mold halves even after they have been removed from their respective flasks.

BACKGROUND

This section provides background information related to the present disclosure, which is not necessarily prior art.

In matchplate sand mold casting, the mold comprises separate open-face cope and drag halves that are fabricated separately, and then joined together, face-to-face prior to pouring the molten metal. Conventionally, the cope and drag molds are formed using a pair of boxes called flasks which are filled with sand with a removable pattern-half embedded in each. When removed, the pattern-halves leave an impression in the sand of the part to be cast. The cope contains the impression of the upper half of the part and the drag contains the impression of the lower half of the part. The cope also typically includes a pouring cup passageway into which molten metal may be poured, and also a vent to allow air to escape during the pour. To ensure a properly molded part is produced, the cope and drag halves must fit together in perfect alignment.

The conventional technique for joining the cope and drag halves involves at least two human workers and a lifting crane. First the cope and drag sand molds are formed in their respective flasks. Then a lifting crane is attached to the cope flask and the structure is lifted and inverted, so that the open-face mold side of the cope is facing downward. Human workers then guide the cope as it is lowered into place on top of the drag. The typical lifting and rotating device is rigidly attached to the outer sidewalls of the flask by brackets carried on a mechanism journaled for rotation about a horizontal axis. Alignment of cope and drag is accomplished visually and manually. Thus high accuracy in the lifting crane and rotating mechanism is not usually required.

With the advent of chemically bonded, no-bake sand, it is now possible with smaller molds (e.g., flask dimensions of about 48 inches or less) to perform the lifting and rotating operation with the flasks removed from the respective cope and drag portions prior to inversion and installing of the cope onto the drag. As before, human operators visually and manually guide the cope into proper position. The lifting and rotating mechanism is different, however, because it must attach directly to the sand sidewalls of the cope. In this application the sidewalls of the molds are typically slightly tapered or frustum-shaped, having a taper of approximately two degrees to five degrees to allow the mold to be slidably removed from the flask without dismantling the flask and without damaging the mold.

Due to this slight inward taper of the sand mold, an articulated joint or knuckle, such as a ball joint or universal joint, is required to allow the attachment plate secured to the mold to change its angle with respect to the rotational axis as 180 degree rotation is effected. However, to ensure that the cope and drag will fit together in perfect alignment, the articulated joint must be manufactured with high precision, as any displacement caused by poor tolerance in the joint will throw the rotated mold out of alignment when it is inverted.

SUMMARY

This section provides a general summary of the disclosure, and is not a comprehensive disclosure of its full scope or all of its features.

The auto-closer system and method disclosed here allows sand mold cope and drag halves to be accurately centered and closed onto one another quite quickly and accurately, entirely by automated mechanism, and without the need for human operators to visually guide alignment to ensure proper closing. While the technique is compatible with vision systems and laser-guided technology, these expensive systems are not required to achieve accurate closure.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

FIG. 5 is a simplified plan view illustrating the operation of the left and right side centering arms of the centering mechanism and also illustrating exemplary cope and drag sand mold halves in process of being assembled;

FIG. 6 is a simplified side elevational view showing the manner of operation of the front and rear centering arms;

FIG. 7 is a simplified side elevational view showing the operation of the gripping structure;

Corresponding reference numerals indicate corresponding parts throughout the several views of the drawings.

DETAILED DESCRIPTION OF THE EMBODIMENTS

Example embodiments will now be described more fully with reference to the accompanying drawings.

Figure 1:
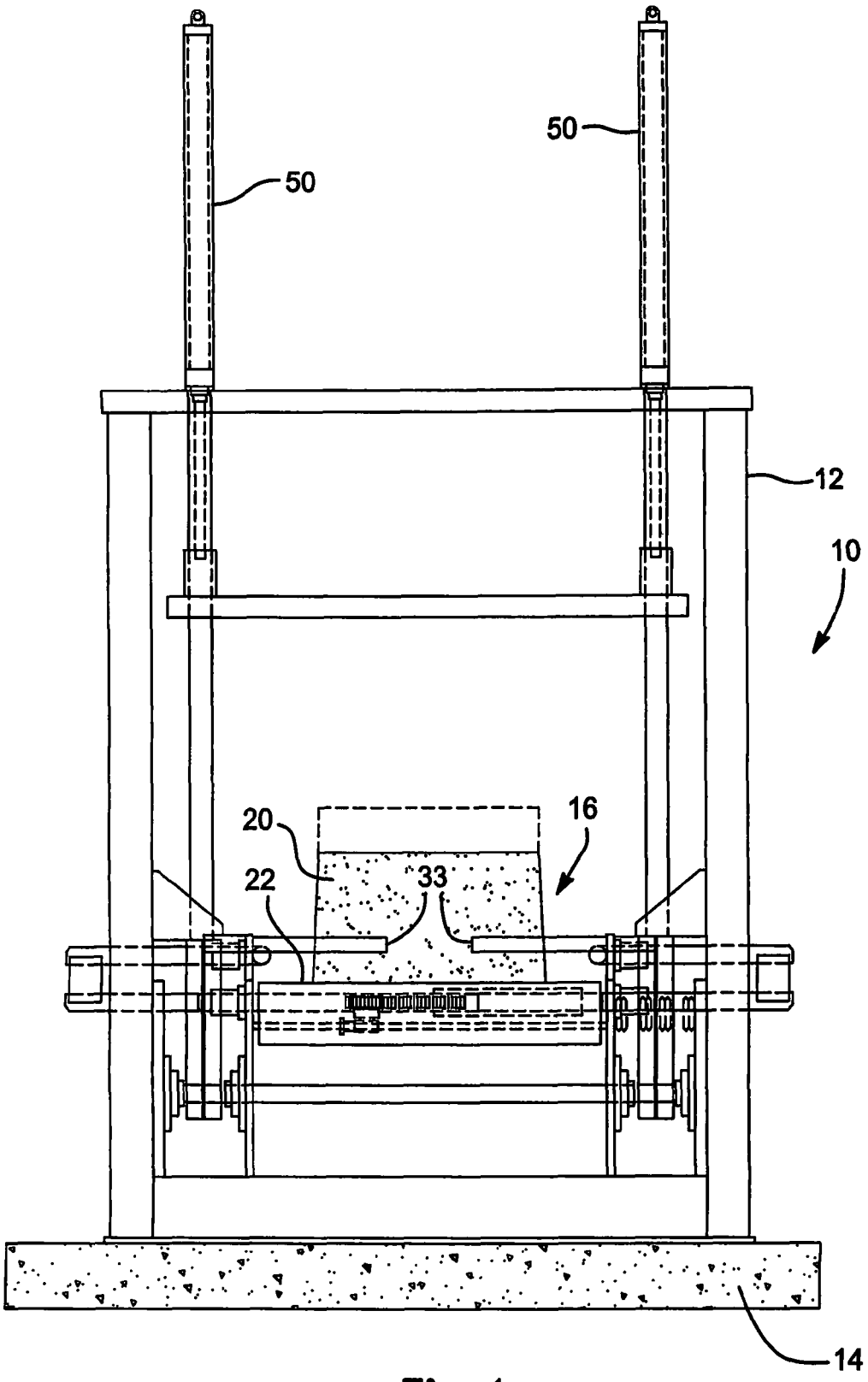
FIG. 1 is an end view of the auto-closer mechanism.
Figure 2:
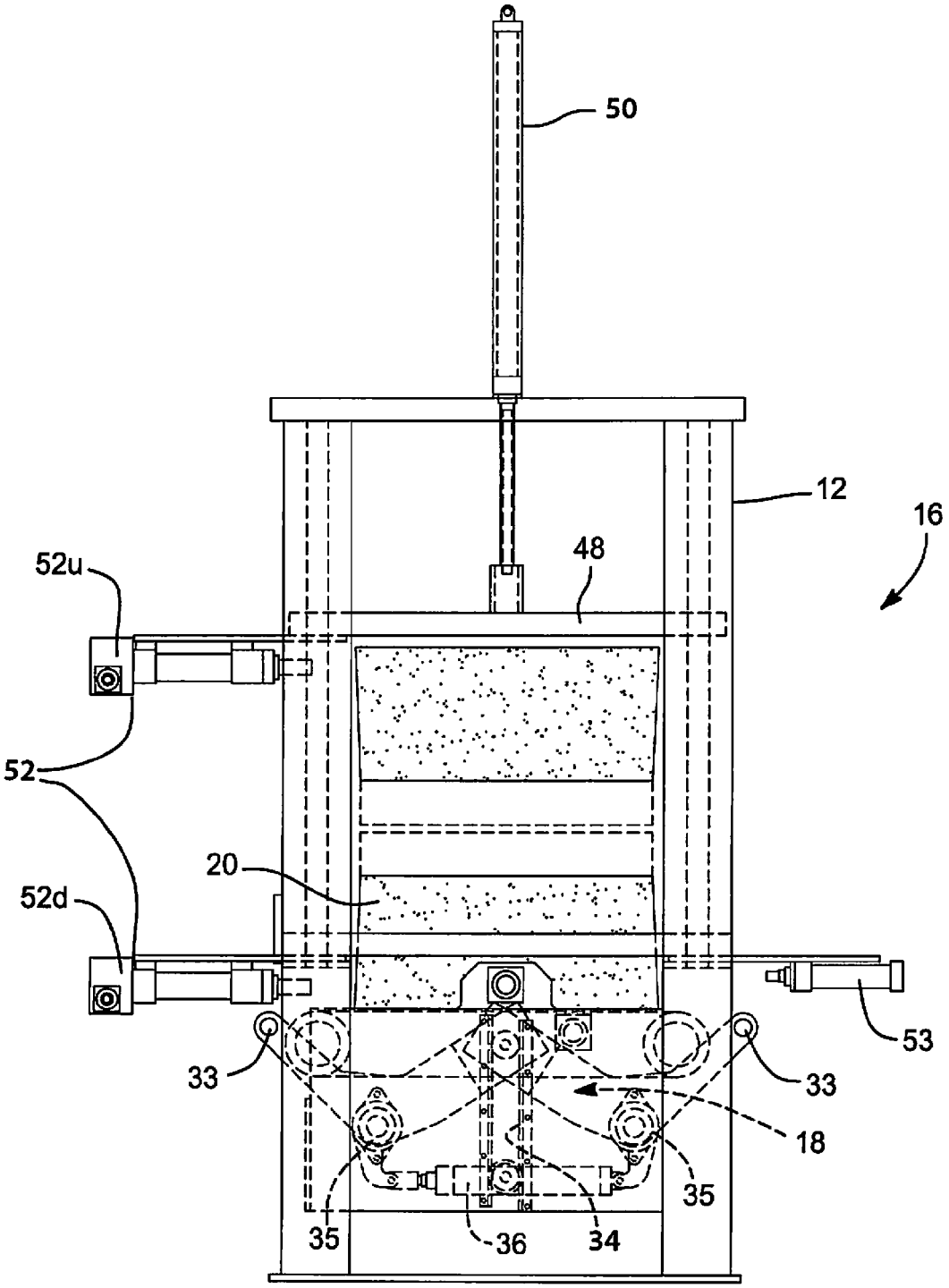
FIG. 2 is a side view of the auto-closer mechanism.

Referring to FIGS. 1 and 2, the auto-closer mechanism has been illustrated generally at 10. The auto-closer mechanism is built on a support structure frame 12 that is preferably mounted securely to the floor 14. The auto-closer mechanism includes a positioning station shown generally at 16 onto which a sand mold half is conveyed and then accurately centered using a centering mechanism 18. In FIG. 1 an exemplary sand mold half has been illustrated at 20. As will be more fully described, the positioning station 16 is adapted to receive both cope and drag halves of a sand mold, in alternating succession. The cope half is first conveyed onto the positioning station and then centered, gripped, lifted and rotated 180 degrees. Then the drag half is conveyed onto the positioning station and centered. The cope is then lowered onto the drag to close the mold.

Figure 3:
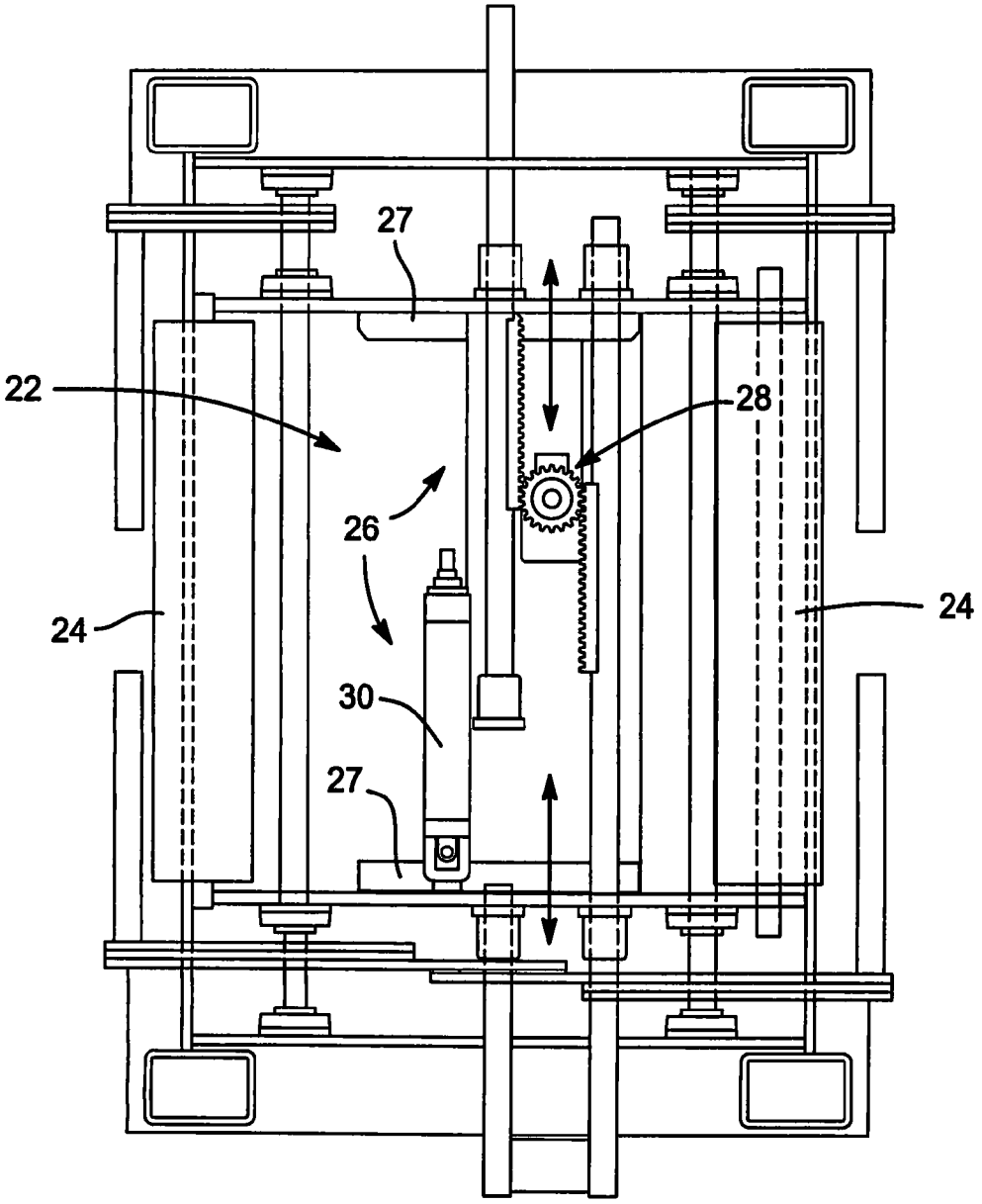
FIG. 3 is a plan view of the auto-closer mechanism with certain components removed to illustrate the inner workings of the centering mechanism.

The positioning station is preferably constructed in the form of a conveyor platform 22 comprising a belt stretched across two conveyor rollers 24, as best seen in FIG. 3. The conveyor belt is preferably fabricated from a belt material that allows a light dusting of sand to remain on the belt as it operates. This light dusting of sand serves to reduce sliding friction between mold half and belt surface, so that the centering mechanism can position the mold half with reduced force.

The centering mechanism 18 comprises a first set of centering arms identified as the left and right side centering arms 26. These centering arms are perhaps best seen in FIG. 3. The arms are hydraulically operated by means of the hydraulically operated rack and pinion mechanism 28. A hydraulic cylinder 30 applies linear force to one of the centering arms 26 and the rack and pinion gearing transmits this force to the other centering arm, causing the two arms to extend and retract inwardly and outwardly in unison in the directions of the arrows shown. Each of the left and right side centering arms is generally T-shaped, with the pusher bar 27 of each being preferably fabricated from cylindrical bar stock so that the pusher bar will make contact with the sand mold with minimal abrading friction due to the circular cross-section of the pusher bar.

The centering mechanism 18 further includes a set of front and rear centering arms 32, which are perhaps best seen in FIGS. 1 and 2. The front and rear centering arms each comprise a pair of spaced apart, axially aligned pusher bars 33, which are also preferably manufactured using cylindrical bar stock to provide minimal abrading friction when contacting the sand mold. The pusher bars are spaced apart as shown in FIG. 1 to provide clearance for the gripping structure yet to be discussed.

As seen in FIG. 2, the front and rear centering arms are driven by a pair of boomerang-shaped cranks, each journaled for rotation about its respective pivot point 35, with the pusher bars 33 being attached to the opposite ends thereof. The inner ends of the boomerang-shaped cranks are coupled through a slidable journaling mechanism that slides through an elongated channel 34 which constrains both boomerang cranks to move in unison, but in opposite directions of rotation. A hydraulic cylinder 36, imparts this rotatory motion by being attached to the cranks as illustrated in FIG. 2. As the cylinder 36 extends, the pusher bars 33 rotate about the respective pivot points 35 on arc-shaped trajectories moving towards one another. When the cylinder 36 contracts, the pusher bars move on the reverse trajectory in a generally outward direction from one another.

Figure 4:
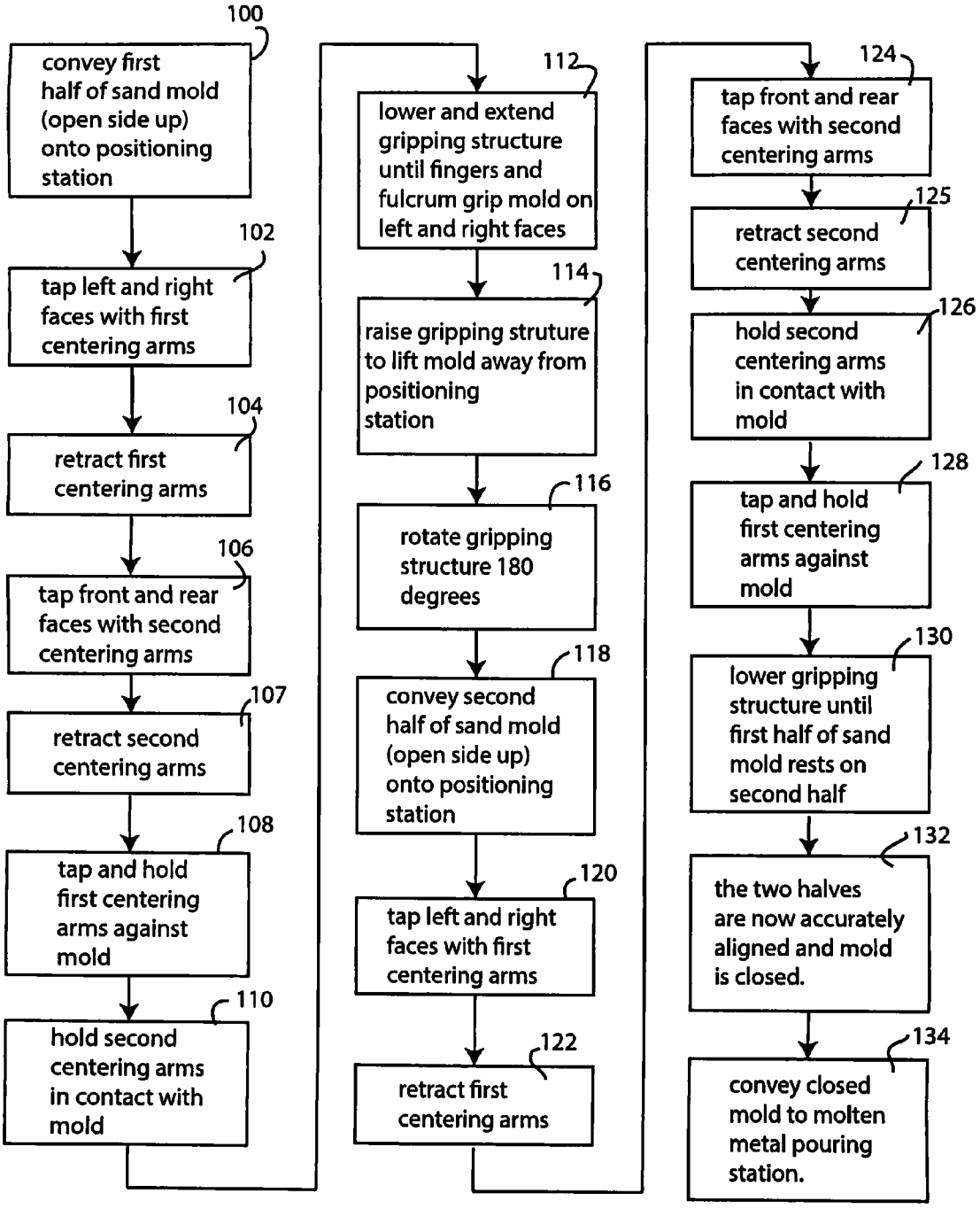
FIG. 4 is a flowchart diagram describing the manner of operation of the auto-closer mechanism.

Refer now to FIGS. 5 and 6 and also to the flowchart of FIG. 4 for a discussion of how the centering mechanism 18 operates. As illustrated in FIG. 5, the conveyor platform 22 serves as the positioning station 16, where an exemplary sand mold cope 20*c* is disposed. Visible from this view, the cope half 20*c* has a hollowed out mold portion 42 with matchplate alignment structures 40. Both mold and alignment structures are built into the configuration of the sand mold itself.

While there are different mechanisms that may be used to place the mold half onto the positioning station, the illustrated embodiment employs a feed conveyor 38 that is positioned to deliver a mold half onto the conveyor platform 22. In use, the cope and drag mold halves are alternately delivered to the positioning station. Thus, as illustrated, the mold half on the positioning station in FIG. 5 is a cope half designated as 20*c*, whereas the mold half next to be delivered is a drag half designated 20*d*. Note that the drag half 20*d* has been placed on the feed conveyor in a somewhat randomly angled position, to illustrate exemplary "real world" foundry conditions. In other words, the sand mold halves arriving from feed conveyor 38 are not necessarily in square alignment with the centering mechanism when delivered.

Referring to FIG. 4, the cope portion is delivered at step 100, with its open side or mold side up. Next, the left and right side centering arms 26 are extended, causing the pusher bars 27 to momentarily contact the mold half along its left and right sides, causing the mold half to move into approximate alignment parallel to the longitudinal dimension of the pusher bars 27. This step is depicted at 102 in FIG. 4.

The side centering arms are then retracted as at step 104 and the front and rear centering arms are then rotated inwardly toward one another (slidably guided by elongated channel 34) so that their respective pusher bars 33 contact the front and rear surfaces of the mold half, as depicted at step 106. This is illustrated in FIG. 6. This motion causes the mold half to become further aligned, this time so that the front and rear faces of the mold are generally parallel to the longitudinal axes of the pusher bars 33. This is depicted at step 106. Then at step 107 the front and rear centering arms are withdrawn, thus momentarily leaving the sand mold half resting on the positioning station without contact from any of the centering mechanisms.

Then in step 108 the left and right centering arms are again extended so that they contact and hold the sand mold half in an aligned position between them. This is depicted at step 108. Unlike the previous centering steps, this time the left and right centering arms remain closed, thus clamping the sand mold in place with respect to the left-right dimension. Next, the front and rear centering arms are likewise rotated into contact with the front and rear faces of the mold, holding those sides in alignment as well. This is illustrated at step 110. Once step 110 has been reached, the mold half is now centered along first centerline 44 parallel to pusher bars 27 and second centerline 45 parallel to pusher bars 33 and is being securely held by clamping forces from the left and right centering arms and by the front and rear centering arms.

The auto-closer mechanism 10 further includes an automated gripping structure that grips, lifts, and rotates the sand mold half, so that it can be mated with a subsequently loaded opposite half. Referring to FIGS. 1 and 2, the gripping structure 46 is mounted on a precision-guided sliding frame 48 that is lifted by a pair of lift cylinders 50. The gripping structure includes a pair of linear rotary actuators 52 that extend longitudinally to grip the sand mold half using a pair of circular gripping pads 54. The circular nature of the gripping pads is perhaps best seen in FIG. 8.

For explanation purposes in FIG. 2, the linear rotary actuator has been illustrated in both its up position at 52*u* and its down position at 52*d*. The linear actuators are driven by hydraulic cylinder 53. One hydraulic pumping system supplies fluid pressure to both actuators concurrently, so that both actuators operate in synchronism and with equal linear force. The details of the gripper pads 54 will be discussed below.

Returning to FIG. 4, at step 112 the gripping structure 46 is lowered to the down position (52*d* of FIG. 2) as also illustrated in FIG. 7. The linear actuators are then extended so that the gripper pads 54 make contact with the sidewalls of the sand mold half. The linear actuators 52 are supplied with sufficient pressure to drive the gripper pad fingers into the sidewalls of the sand mold, as will be discussed more fully below.

Next, at step 114 the gripping structure is raised by retracting the lift cylinders 50, causing the mold to be lifted away from the positioning station 16. Next, as depicted at step 116 the gripping structure is rotated about its rotatory axis until a 180-degree rotation is achieved. This effectively inverts the sand mold half so that it will be in a position to mate with the other half once lowered.

In step 118 the second half of the sand mold (open side up) is conveyed onto the positioning station. The same series of centering steps are performed at 120-128 as previously described in connection with steps 102-110. These centering steps thus align the second half of the sand mold so that it is in precisely the same position as the first half had been prior to being lifted. Then at step 130 the gripping structure is lowered by extending the lift cylinders 50 until the first half of the sand mold rests on the second half. In doing so, the alignment structures 40 on the respective halves mate with one another to ensure perfect alignment. This is depicted at step 132. Finally, the closed mold is conveyed as at step 134 away from the positioning station and onto a molten metal pouring station where the cast metal part is formed.

In order to ensure tight gripping of the sand mold half being lifted, the gripping cylinders 53 is first supplied with hydraulic fluid under low pressure (nominally 50 PSI) until a certain predefined distance of travel has been achieved. This distance can be determined by calculation by knowing the rate of cylinder travel and thus measuring distance by measuring a predefined travel time. Once the gripping pad is in loose contact with the sides of the sand mold half, a higher pressure is applied (nominally 500 PSI) which causes the gripping structure to more tightly grip the sand mold half. This tight grip is sustained throughout the lifting and rotating process by blocking the valve supplying fluid to the cylinder 53. In effect, the supply valve is moved to a position where its ports are blocked by the valve, causing the fluid pressure to be retained in the cylinder. Blocking the valve in this fashion may be accomplished by employing a second valve on the exit hose of the main valve, so that fluid pressure cannot be relieved.

Figure 8:
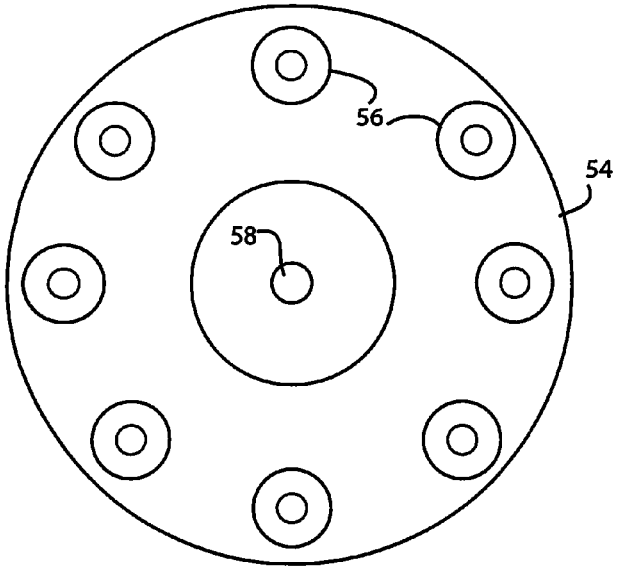
FIG. 8 is an end view of the gripper pad with spring-loaded pins and center-fixed fulcrum.
Figure 9:
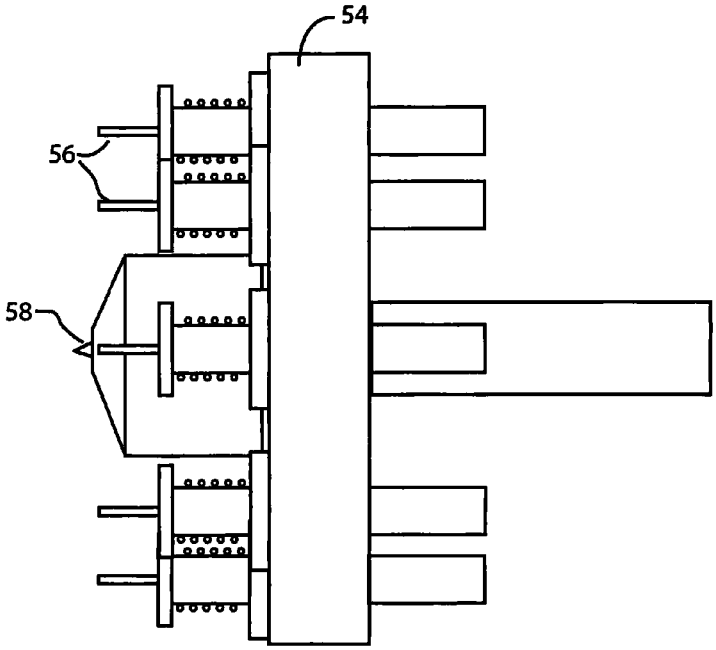
FIG. 9 is a side elevational view of the gripper pad of FIG. 8.

Referring now to FIGS. 8 and 9, the gripper pad configuration will now be discussed in detail. As illustrated in FIG. 8, the gripper pad 54 is preferably of circular configuration. A plurality of individual spring-loaded pins 56 are equally distributed around the periphery of the pad and a fixed pin 58 is disposed at the center. The gripping structure with extendable and retractable pins is designed to firmly grip the sand mold and yet permit the mold to be rotated 180 degrees from the initial centering position to the final mating position.

Figure 10A:
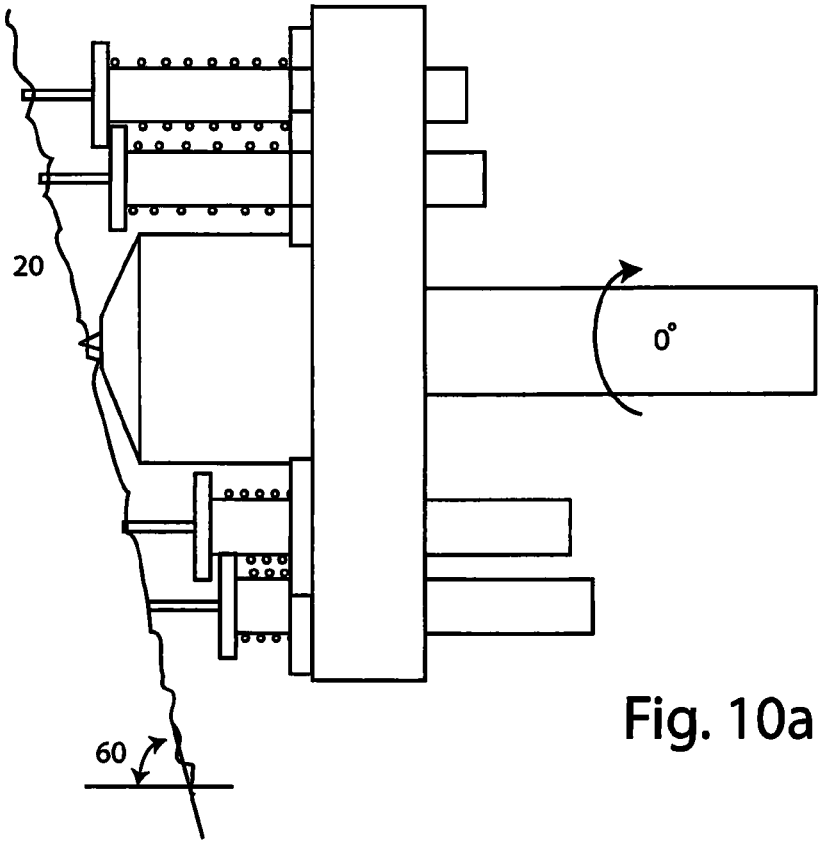
FIGS. 10*a* and 10*b* illustrate how the spring-loaded pins operate during rotation of the gripper pad to accommodate the frustum angle of the sand mold, with selected pins having been removed to simplify the illustration.
Figure 10B:
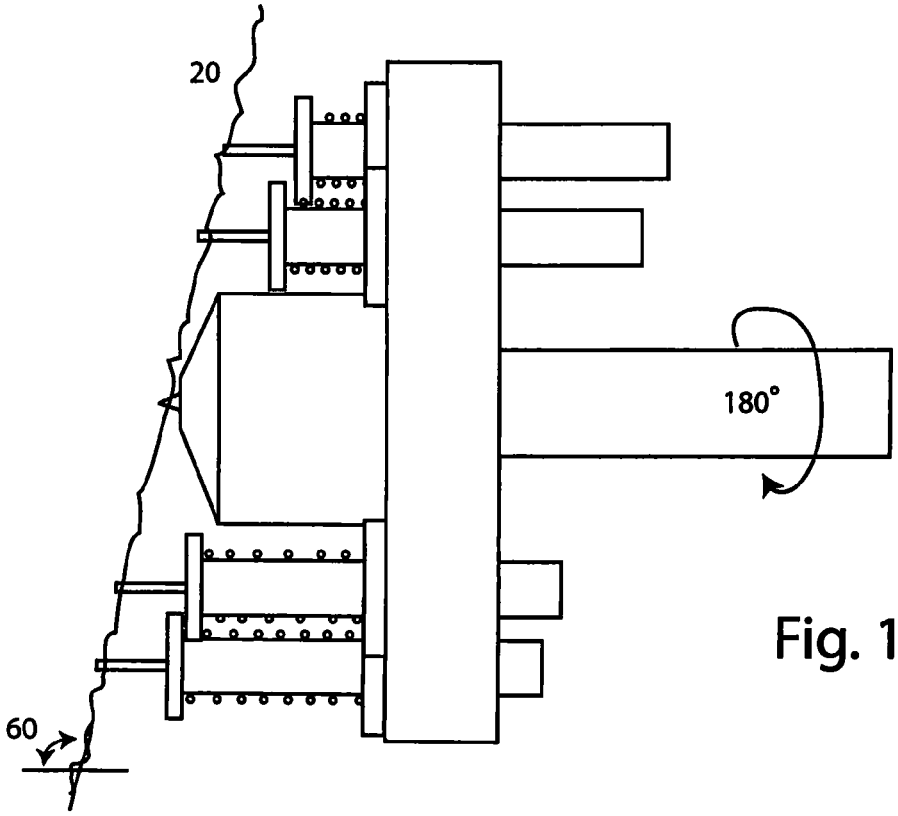

Shown in FIGS. 10*a* and 10*b*, it can be seen that the individual spring-loaded pins will change in length automatically by compressing and decompressing the springs so that the pins remain driven into the side walls of the sand mold even as it makes the 180 degree rotation. In the illustration of FIGS. 10*a* and 10*b*, note how the inclined sidewall 60 changes its angle from upwardly inwardly sloping to upwardly outwardly sloping as the rotatory actuator rotates from its initial zero-degree position to its final 180-degree position. The center fixed pin 58, which may be pointed or rounded, serves as a fulcrum about which the surface of the sand mold can rock, allowing the spring-loaded pins to extend and extract as needed while the fixed center pin keeps the sand mold accurately centered above the positioning station below.

Figure 11:
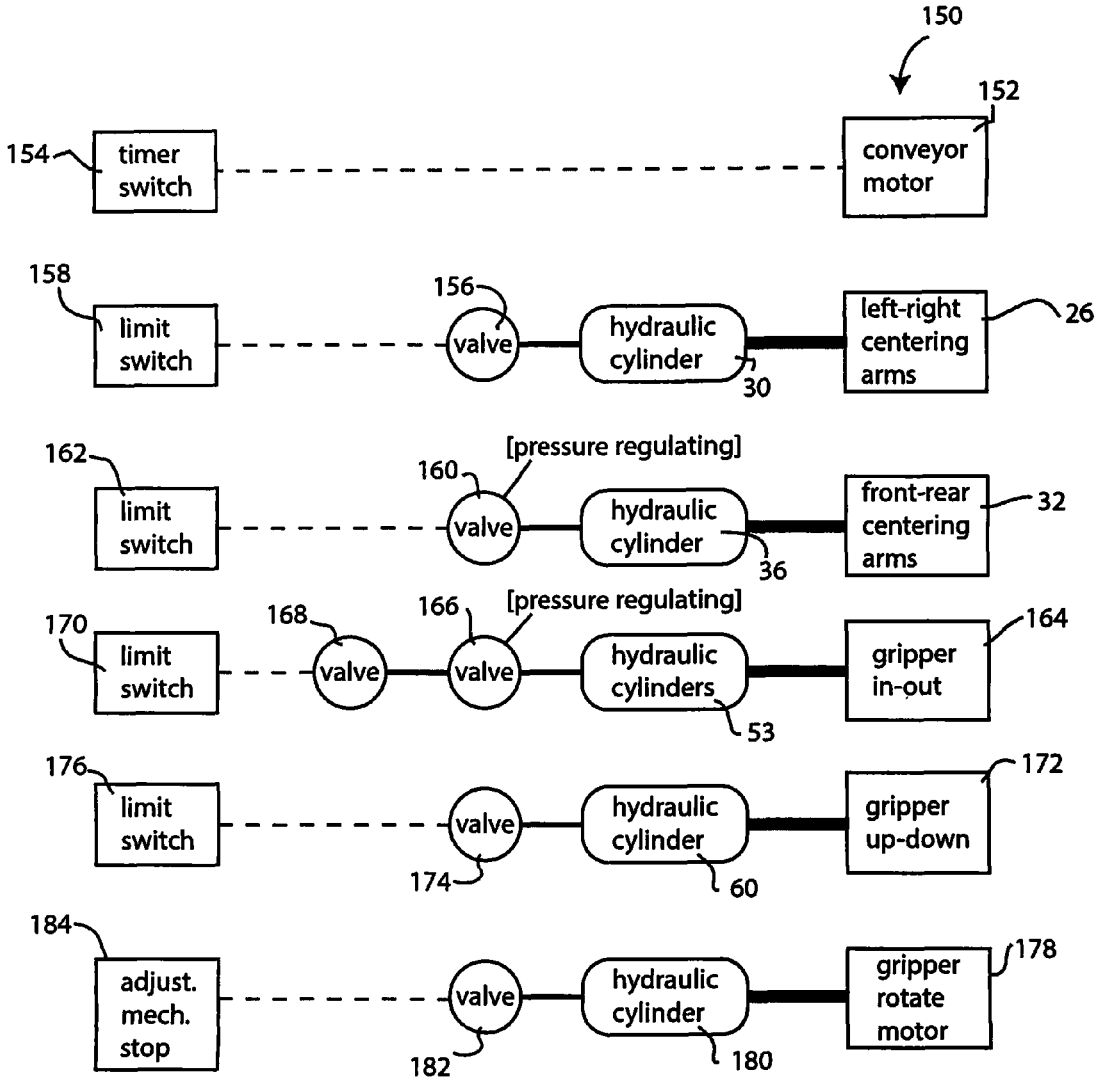
FIG. 11 is a control logic diagram showing how the various moving components of the auto-closer are controlled.

While the various moving systems of the auto-closer can be controlled in a variety of ways, including computer-implemented control systems, the basic control scheme depicted in FIG. 11 is presently preferred, in foundry applications where the control system may be exposed to the heat, dust and potential physical abuse of a real-world foundry floor. To provide a rugged and reliable system for these conditions, the control system uses simple timer switches and limit switches, controlling electric actuators and motors directly or controlling valves which in turn control hydraulic cylinders.

Referring to FIG. 11, the various moving systems of the auto-closer are depicted vertically along the right side of the Figure at 150. The conveyor motor 152 drives the conveyor rollers 24 (FIG. 3). A similar conveyor motor (not shown) would drive the feed conveyor 38 that supplies the cope and drag halves to the positioning station. As illustrated, the conveyor motor is controlled by a timer switch 154. The timer switch is energized concurrently with energizing of the feed conveyor 38 and continues to supply electrical energy to the conveyor motor 152 for a measured time, programmed to allow a cope or drag half to move to generally the center of the positioning station 16.

The left and right centering arms 26 are supplied with mechanical energy from hydraulic cylinder 30. Movement is controlled by valve 156 which controls the supply of hydraulic fluid into and out from hydraulic cylinder 30. Valve 156 is controlled using a fluid control mechanism 158. Alternatively an electrically controlled by a limit switch may be used. The control mechanism 158 or limit switch may be secured to the centering arms, or elsewhere, to sense when a predetermined pressure has been applied to the sidewalls of the cope or drag.

Similarly the front and rear centering arms 32 are supplied with mechanical energy from hydraulic cylinder 36, driven by valve 160 controlled by a fluid control mechanism 162 (or alternatively by a sensing device such as a limit switch) to ensure that the centering arms grip the cope or drag with a predetermined pressure.

The gripping structure 46 is mechanically driven into and out of gripping contact with the cope, as designated by motion 164 in FIG. 11 by the hydraulic clamp cylinder 53. Valve 166 supplies hydraulic fluid to cylinder 53 to impart the gripping action, with gripping pressure being controlled by limit switch 170. To ensure that the gripping pressure is sustained during subsequent lifting and rotating operations, a second valve 168 supplies hydraulic fluid to the valve 166. By actuating valve 168, fluid within valve 166 and cylinder 53 is prevented from escaping. This effectively "locks" cylinder 53 in an extended state whereby gripping pressure on the cope is solidly maintained.

Lifting motion of the gripping structure, shown as motion 172 in FIG. 11 is effected by the pair of hydraulic cylinders 60 supplied in parallel with hydraulic fluid by valve 174. Valve 174 may be controlled by a limit switch 176, or by timer switch in the alternative. Rotation of the gripping structure is then performed by hydraulic rotation motor 178, driven by hydraulic cylinder 180 and valve 182, which are controlled by mechanically adjustable stops 184 to achieve 180 degree rotation of the cope.

Accuracy of the automated device can be attributed to several factors. First, the cope and drag mold halves are accurately positioned and held in place as the gripping structure is attached. Thus prior to lifting, the centering arms are responsible for maintaining accurate alignment, and by virtue of the centering arm geometry, this accuracy is repeatably achieved without the need for expensive machine vision systems or human workers.

Once the gripping structure grabs and lifts the sand mold half, accurate positioning alignment is maintained by the precision-guided sliding frame 48. The frame ensures that the gripping structure lifts the mold away from the centering station while maintaining it accurately on vertical center with respect to the centering station. Dual lift cylinders 50 driven by a common hydraulic supply valve ensure that lifting is performed without any canting or twisting of the gripping structure.

Because the mold is held firmly between the respective fixed pins 58 of the gripping pads, and because the axes of the respective gripping pad axles are accurately, axially aligned, the mold remains accurately "on-center" with respect to the vertical centerline of the centering station even as it is rotated 180 degrees. While the individual spring loaded pins can extend and retract, as needed, during rotation, the mold remains in accurate alignment because it is captured between the two fixed pins 58. Again, no expensive machine vision system or human operators are required to maintain the mold in accurate alignment. Thus when the mold is lowered onto the drag half held on-center below, the automated mechanism ensures that the two mold halves will mate up accurately, and repeatably without the need for human operators or expensive machine vision systems to make any last minute positioning adjustments.

The advantage of working automatically, without complex machine vision systems cannot be overstated. The typical foundry environment is hot and noisy, with sand particles everywhere. It is not an environment that is particularly friendly to sophisticated vision systems. Moreover, while foundry workers are well trained to perform their specific job, they are typically not well trained in operating and maintaining complex technical systems. The disclosed auto-closer mechanism is ideal in this environment because it can perform its job accurately and automatically and there are few complex technology components that need adjusting or maintenance.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An auto-closer apparatus for centering and closing cope and drag mold halves of sand mold, said apparatus comprising:

a positioning station having a planar platform adapted to support a sand mold half while centering;

the positioning station having a first set of opposing arms moveable toward and away from each other, the arms being moveable over a range sufficient to contact first opposing exterior surfaces of the sand mold half, to cause the sand mold half to move and become centered along a first centerline between the first set of opposing arms;

the positioning station having a second set of opposing arms moveable toward and away from each other, the arms being moveable over a range sufficient to contact second opposing exterior surfaces of the sand mold half, to cause the sand mold half to move and become centered along a second centerline between the second set of opposing arms, the second centerline being substantially orthogonal to the first centerline;

a gripping structure having two opposing and inwardly facing pads each mounted for rotation about a common axis on separate axles, whereby the pads remain in a fixed angular relationship to one another throughout rotational movement;

each pad having plural individual compressible fingers pointing inwardly towards the opposite pad and adapted to grip a sand mold half by engaging the surface of the sand mold half;

each pad having a fixed fulcrum structure pointing inwardly towards the opposite pad and being disposed in line with the common axis, with the individual compressible fingers being disposed radially outwardly from the fulcrum structure;

a first actuator coupled to the gripping structure that moves the gripping structure inwardly and outwardly along the common axis, over a sufficient range whereby inward movement brings the compressible fingers and fulcrum structure in contact with the surface of the sand mold half, and whereby outward movement releases the compressible fingers and fulcrum structure from contact with the surface of the sand mold half;

a second actuator coupled to the gripping structure that moves the gripping structure closer to and farther from the platform of the positioning station over range sufficient to lift a sand mold half when gripped by said gripping structure a distance away from the platform sufficient to place a second sand mold half on the platform.

2. The apparatus of claim 1 wherein the first set of opposing arms include a fluid pressure drive mechanism that produces movement to cause centering of the sand mold along the first centerline.

3. The apparatus of claim 1 wherein said first set of opposing arms includes a linkage mechanism coupled to cause said first set of arms to move in unison toward and away from each other.

4. The apparatus of claim 1 wherein said first set of opposing arms includes a fluid pressure drive mechanism coupled to a linkage mechanism that is in turn coupled to cause said first set of arms to move in unison toward and away from each other.

5. The apparatus of claim 1 wherein the first and second sets of opposing arms each include a fluid pressure drive mechanism that produces movement to cause centering of the sand mold along each of said respective first and second centerlines.

6. The apparatus of claim 1 wherein said first and second sets of opposing arms each includes a linkage mechanism coupled to cause said respective first and second set of arms to move in unison toward and away from each other.

7. The apparatus of claim 1 wherein said first and second sets of opposing arms each includes a fluid pressure drive mechanism coupled to a linkage mechanism that is in turn coupled to cause said respective first set and second sets of arms to move in unison toward and away from each other.

8. The apparatus of claim 1 wherein said plural individual compressible fingers are spring-loaded to apply gripping pressure during engagement of the surface of the sand mold half.

9. The apparatus of claim 1 wherein said first actuator includes a fluid pressure drive mechanism to produce gripping force of the fingers into the sand mold half.

10. The apparatus of claim 1 wherein said second actuator includes a fluid pressure drive mechanism to produce motion of the gripping structure closer to and farther from the platform of the positioning station.

* * * * *